US008534209B2

(12) United States Patent
Hirata

(10) Patent No.: US 8,534,209 B2
(45) Date of Patent: Sep. 17, 2013

(54) SEWING MACHINE AND COMPUTER PROGRAM PRODUCT

(75) Inventor: Takashi Hirata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 250 days.

(21) Appl. No.: 13/212,570

(22) Filed: Aug. 18, 2011

(65) Prior Publication Data

US 2012/0042816 A1 Feb. 23, 2012

(30) Foreign Application Priority Data

Aug. 23, 2010 (JP) ..... 2010-186563

(51) Int. Cl.
*D05B 21/00* (2006.01)

(52) U.S. Cl.
USPC ..... 112/102.5; 112/470.06; 112/475.19; 700/138

(58) Field of Classification Search
USPC ..... 112/102.5, 103, 470.01, 470.06, 112/475.18, 475.19; 700/136–138
See application file for complete search history.

(56) References Cited

U.S. PATENT DOCUMENTS

| | | | | |
|---|---|---|---|---|
| 6,032,594 | A * | 3/2000 | Komuro | 112/102.5 |
| 6,289,831 | B1 * | 9/2001 | Hanai et al. | 112/102.5 |
| 6,644,227 | B2 * | 11/2003 | Sano et al. | 112/102.5 |
| 6,820,565 | B1 * | 11/2004 | Kawaguchi et al. | 112/102.5 |
| 7,392,755 | B2 * | 7/2008 | Kato et al. | 112/102.5 |
| 2001/0025592 | A1 * | 10/2001 | Hirose | 112/102.5 |
| 2002/0083873 | A1 * | 7/2002 | Sano et al. | 112/102.5 |
| 2007/0221107 | A1 | 9/2007 | Kato et al. | |

FOREIGN PATENT DOCUMENTS

| | | |
|---|---|---|
| JP | B2-60-36499 | 8/1985 |
| JP | A-6-319880 | 11/1994 |
| JP | A-2007-252616 | 10/2007 |

* cited by examiner

*Primary Examiner* — Nathan Durham
(74) *Attorney, Agent, or Firm* — Oliff & Berridge, PLC

(57) ABSTRACT

A sewing machine comprises a transport portion that moves an embroidery frame, a contact detection portion that detects contact with the embroidery frame, a first position identification portion that identifies a first position, a second position identification portion that identifies a second position, a direction determination portion that determines a direction of a diagonal line of a virtual rectangle, a third position identification portion that identifies a third position, and an area setting portion that sets a sewable area.

12 Claims, 15 Drawing Sheets

SEWING MACHINE AND COMPUTER PROGRAM PRODUCT

CROSS-REFERENCE TO RELATED APPLICATION

This application claims priority to Japanese Patent Application No. 2010-186563, filed Aug. 23, 2010, the disclosure of which is incorporated herein by reference in its entirety.

BACKGROUND

The present invention relates to a sewing machine that moves an embroidery frame holding a work cloth and sews an embroidery pattern and to a computer program product that causes the sewing machine to sew the embroidery pattern.

Recently, sewing machines are known that can detect a size of an embroidery frame used when sewing. This type of sewing machine is provided with an embroidery machine, to which the embroidery frame is attached, that moves the embroidery frame in an X axis direction and a Y axis direction, and with a tiltable lever that detects the size of the embroidery frame. A shape of the embroidery frame is substantially a rectangular shape. In a state in which the tiltable lever has been caused to slide to a downward position, a position of a front portion of the embroidery frame is detected by driving the embroidery frame in the X axis direction until the front portion of the embroidery frame comes into contact with the tiltable lever. A position of a rear portion of the embroidery frame is detected by driving the embroidery frame in a negative direction of the X axis until the rear portion of the embroidery frame comes into contact with the tiltable lever. The size of the embroidery frame is determined based on the detected positions of the front portion and the rear portion of the embroidery frame.

SUMMARY

When an area of the embroidery frame on which the embroidery pattern can be sewn (hereinafter referred to as a sewable area) is set, it is preferable to set the sewable area such that the embroidery frame does not come into contact with a presser foot during sewing. More specifically, it is preferable to take into account the size of the presser foot and to set the size of the sewable area to be slightly smaller than the size of the embroidery frame. When the shape of the embroidery frame is a substantially rectangular shape, normally, four locations of the corners of the rectangular shape (four corners) are formed in an arc. For that reason, when the roundness (angle R) of the corners is taken into account, it is preferable to set the sewable area to be even smaller.

In the above-described example of the sewing machine, a length of the embroidery frame in the front-rear direction is identified, based on the positions of the front portion and the rear portion of the substantially rectangular shaped embroidery frame. Similarly, if positions of a left portion and a right portion of the embroidery frame are detected, it is also possible to identify a length of the embroidery frame in the left-right direction. However, in the above-described example of the sewing machine, as it not possible to identify a size of the roundness (the angle R) of the corners of the substantially rectangular shaped embroidery frame, it is not possible to set the sewable area while taking into account the roundness (the angle R) of the corners. As a result, when sewing is performed using the substantially rectangular shaped embroidery frame that has arc-shaped corners, there are concerns that the presser foot may come into contact with the corners of the embroidery frame during sewing.

Various exemplary embodiments of the general principles herein provide a sewing machine and a computer program product that are capable of setting an appropriate sewable area even when sewing is performed using an embroidery frame that has arc-shaped corners.

The exemplary embodiments provide a sewing machine comprising a transport portion that moves an embroidery frame that holds a work cloth on which embroidery is sewn; a contact detection portion that is disposed on an inner peripheral side of the embroidery frame and that detects contact with the embroidery frame that is moved by the transport portion; a first position identification portion that causes the transport portion to move the embroidery frame in a first direction and that identifies a first position at which contact with the embroidery frame is detected by the contact detection portion; a second position identification portion that causes the transport portion to move the embroidery frame in a second direction and that identifies a second position at which contact with the embroidery frame is detected by the contact detection portion, the second direction orthogonally intersecting the first direction; a direction determination portion that determines a third direction that is a direction of a diagonal line of a first virtual rectangle, which is calculated from the first position identified by the first position identification portion and the second position identified by the second position identification portion; a third position identification portion that causes the transport portion to move the embroidery frame in the third direction determined by the direction determination portion, and that identifies a third position at which contact with the embroidery frame is detected by the contact detection portion; and an area setting portion that, based on a second virtual rectangle that is calculated from the third position identified by the third position identification portion, sets a sewable area that is an area on which an embroidery pattern can be sewn within the embroidery frame.

The exemplary embodiments also provide a computer program product stored on a non-transitory computer-readable medium, comprising instructions for causing a computer of a sewing machine which includes a transport portion that moves an embroidery frame that holds a work cloth on which embroidery is sewn, and a contact detection portion that is disposed on an inner peripheral side of the embroidery frame and that detects contact with the embroidery frame that is moved by the transport portion to execute the steps of: causing the transport portion to move the embroidery frame in a first direction and identifying a first position at which contact with the embroidery frame is detected by the contact detection portion; causing the transport portion to move the embroidery frame in a second direction and identifying a second position at which contact with the embroidery frame is detected by the contact detection portion, the second direction orthogonally intersecting the first direction; determining a third direction that is a direction of a diagonal line of a first virtual rectangle, which is calculated from the identified first position and the identified second position; causing the transport portion to move the embroidery frame in the determined third direction and identifying a third position at which contact with the embroidery frame is detected by the contact detection portion; and setting a sewable area based on a second virtual rectangle that is calculated from the identified third position, the sewable area being an area on which an embroidery pattern can be sewn within the embroidery frame.

BRIEF DESCRIPTION OF THE DRAWINGS

Exemplary embodiments of the present disclosure will be described below in detail with reference to the accompanying drawings in which.

DETAILED DESCRIPTION

Hereinafter, exemplary embodiments of the present disclosure will be explained with reference to the appended drawings. The drawings are used to explain technological features that the present disclosure can utilize and are merely explanatory examples.

A physical configuration of a sewing machine 1 will be explained with reference to FIG. 1 and FIG. 2. In the following explanation, the lower right side, the upper left side, the lower left side and the upper right side in FIG. 1 respectively correspond to the front side, the rear side, the left side and the right side of the sewing machine 1.

Figure 1:
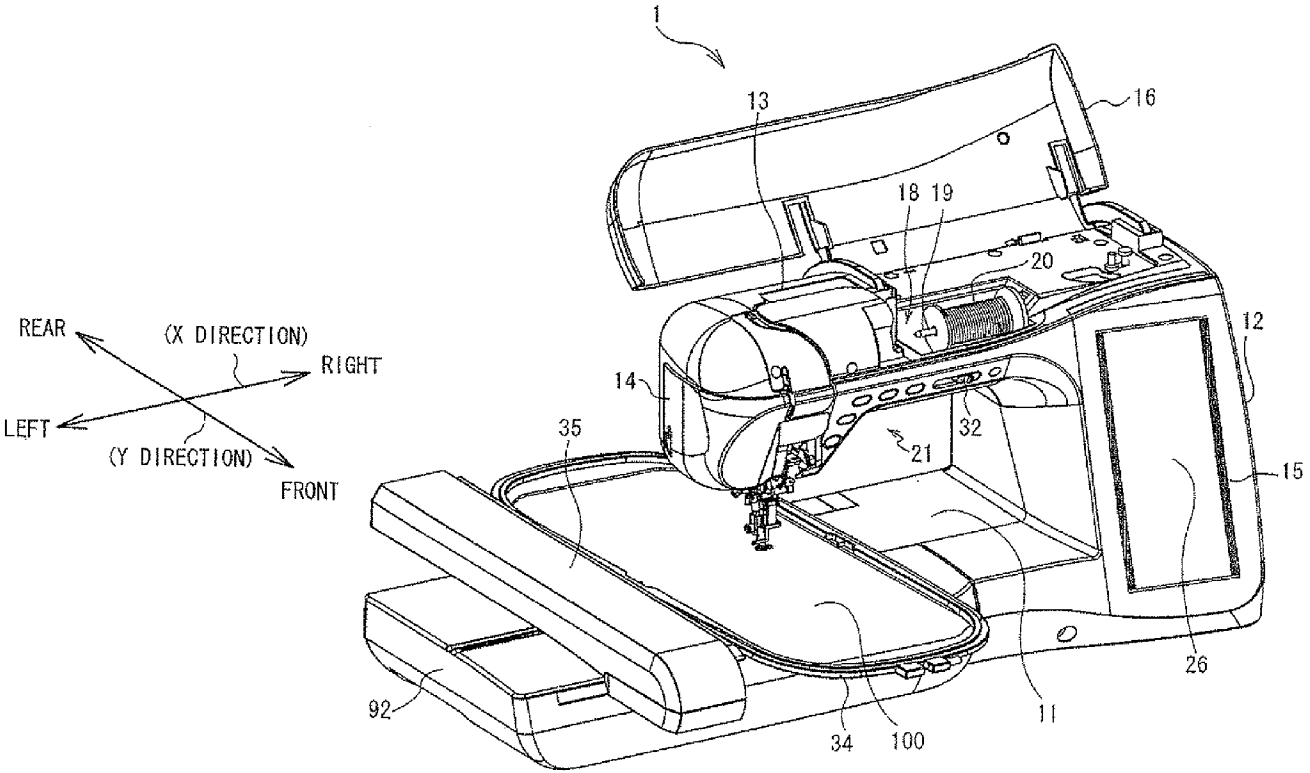
FIG. 1 is a perspective view of a sewing machine 1 as seen diagonally from the front left.
Figure 2:
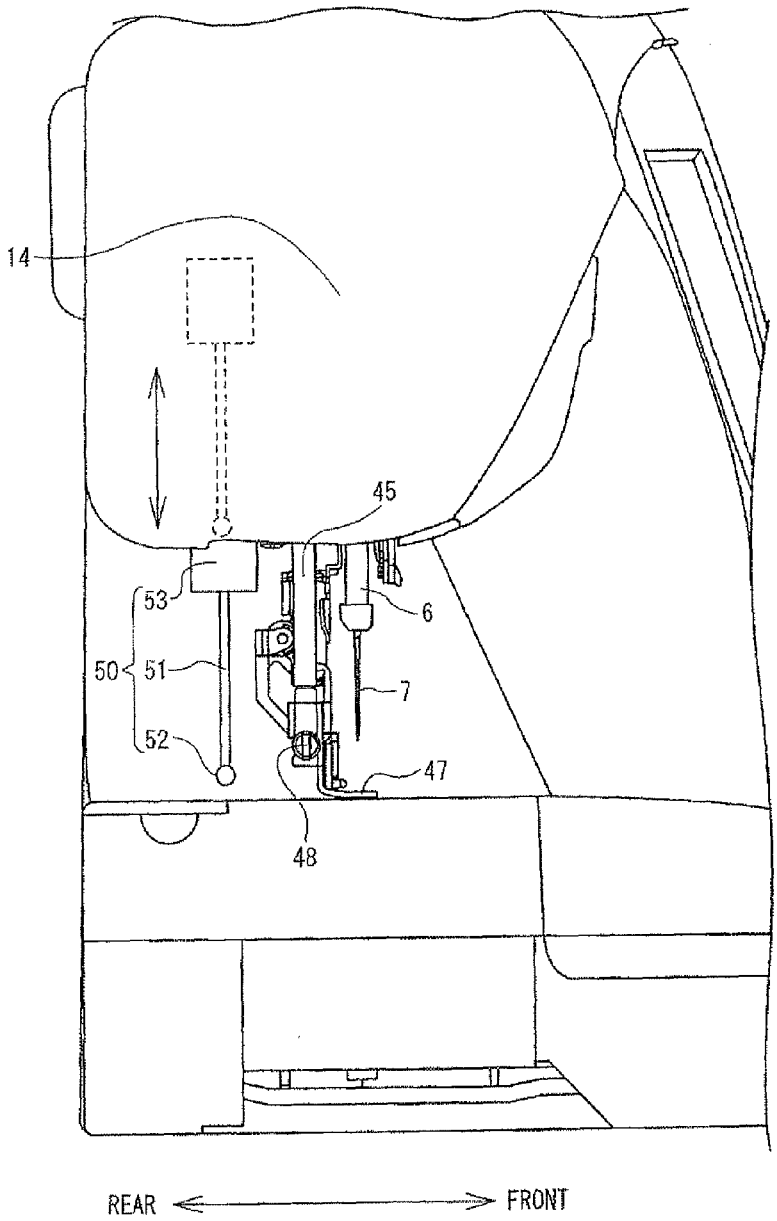
FIG. 2 is a left-side view in which a vicinity of a needle bar 6, a stitching needle 7, a presser bar 45 and a presser foot 47 is enlarged.

As shown in FIG. 1, the sewing machine 1 is provided with a sewing machine bed 11 that is longer in the left-right direction. A pillar 12 is provided standing in an upward direction on a right end portion of the sewing machine bed 11. An arm portion 13 is provided on an upper end of the pillar 12 and extends in the left direction. A head portion 14 is provided on a left-most end portion of the arm portion 13. A needle plate (not shown in the figures) is disposed on an upper surface of the sewing machine bed 11. A feed dog, a feed mechanism, a shuttle mechanism (not shown in the figures) and a feed adjustment motor 78 (refer to FIG. 3) are provided on a lower side of the needle plate (namely inside the sewing machine bed 11). The feed dog is driven by the feed mechanism and moves a work cloth by a predetermined feed amount. The feed amount of the feed dog is adjusted by the feed adjustment motor 78.

Figure 9:
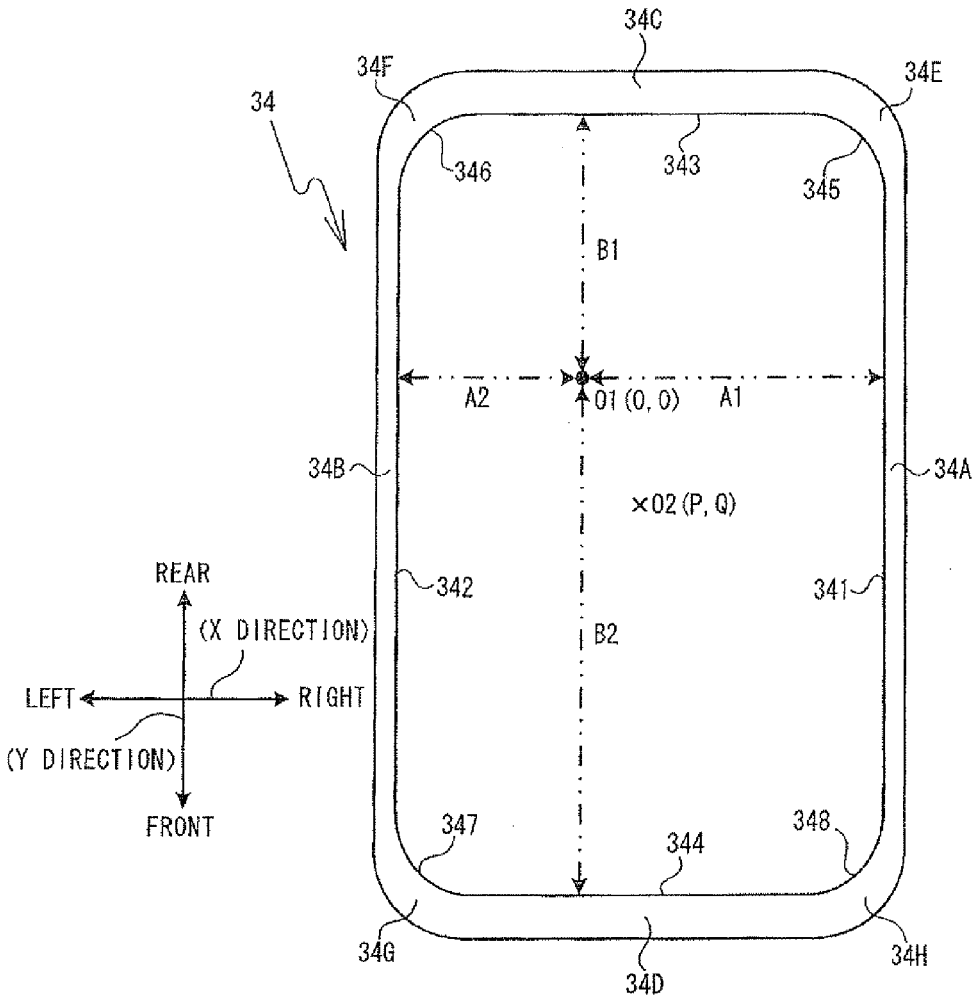
FIG. 9 is a plan view of an embroidery frame 34, showing an initial origin point O1 and a frame origin point O2.
Figure 13:
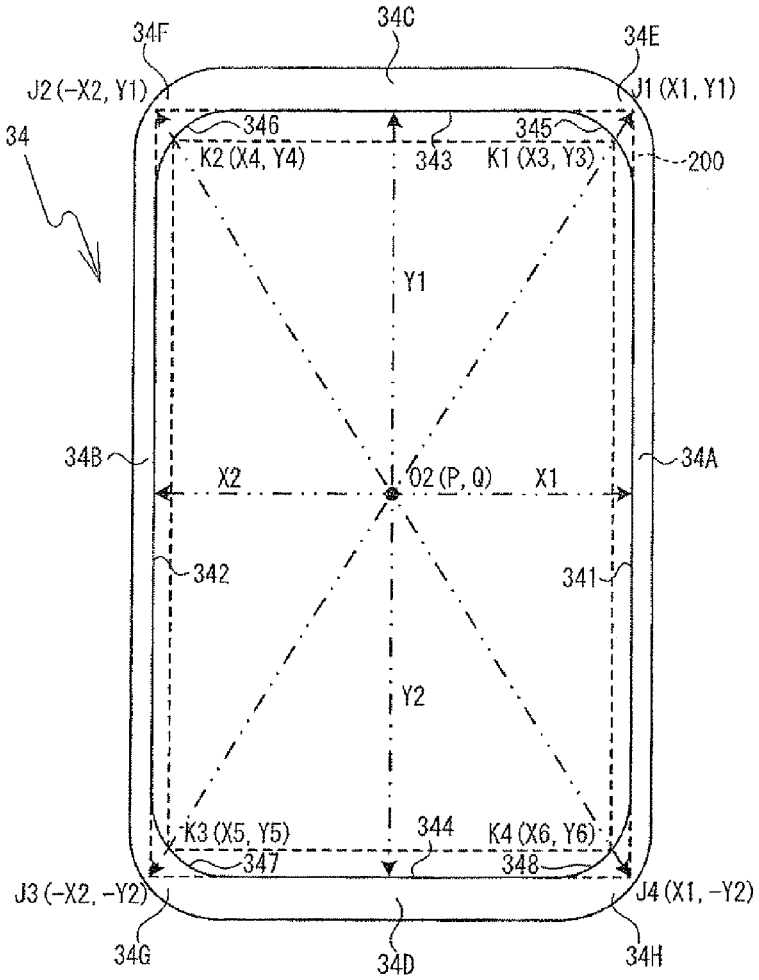
FIG. 13 is a plan view of the embroidery frame 34, showing coordinates J1 to J4 and coordinates K1 to K4.

An embroidery frame 34 that holds a work cloth 100 is disposed on top of the sewing machine bed 11. The embroidery frame 34 has a known structure in which the work cloth 100 is held by being clamped between an inner frame and an outer frame. An inner side area of the embroidery frame 34 is an area on which stitches of an embroidery pattern can be formed. As also shown in FIG. 9, the embroidery frame 34 according to the present embodiment has a substantially rectangular shape in a plan view, and is longer in a front-rear direction. Long sides 34A and 34B and short sides 34C and 34D are substantially straight lines, and corners (in four locations) 34E, 34F, 34G and 34H are arc-shaped. For the purpose of explanation, the embroidery frame 34 shown in FIG. 9 is shown as a simplified shape of the embroidery frame 34 shown in FIG. 1 (this also applies to FIG. 13 and FIG. 15).

An embroidery frame transport device 92 that moves the embroidery frame 34 has a known structure and a simple explanation will therefore be given here. The embroidery frame transport device 92 can be attached to and removed from the sewing machine bed 11. A carriage cover 35 is provided on an upper portion of the embroidery frame transport device 92 and extends in the front-rear direction. Inside the carriage cover 35 are provided a carriage (not shown in the figures) to which the embroidery frame 34 can be detachably attached, and a Y axis transport mechanism (not shown in the figures) that moves the carriage in the front-rear direction (Y direction). The Y axis transport mechanism is driven by a Y axis motor 84 (refer to FIG. 3).

Inside a main body of the embroidery frame transport device 92 is provided an X axis transport mechanism (not shown in the figures) that moves the carriage, the Y axis transport mechanism and the carriage cover 35 in the left-right direction (X direction). The X axis transport mechanism is driven by an X axis motor 83 (refer to FIG. 3). In line with the carriage, the Y axis transport mechanism and the carriage cover 35 being moved in the left-right direction (the X direction), the embroidery frame 34 is moved in the left-right direction (the X direction).

In this way, by driving a needle bar 6 (refer to FIG. 2) and the shuttle mechanism (not shown in the figures) while moving the embroidery frame 34 in the left-right direction (the X direction) and in the front-rear direction (the Y direction), the embroidery pattern is sewn on the work cloth 100 that is held by the embroidery frame 34. Further, when sewing an ordinary pattern that is not an embroidery pattern, the ordinary pattern is sewn while moving the work cloth 100 using the feed dog, in a state in which the embroidery frame transport device 92 is removed from the sewing machine bed 11.

A liquid crystal display 15, that has a vertical rectangular shape, is provided on a front surface of the pillar 12. Various commands, illustrations, setting values, messages and the like are displayed on the liquid crystal display 15. A touch panel 26, which is pressure operated by a user using a finger or a pen or the like, is provided on the liquid crystal display 15. Hereinafter, the pressure operation of the touch panel 26 is referred to as a "panel operation." For example, by the panel operation, the user can select a command executed by the sewing machine 1, select an embroidery pattern to be sewn on the work cloth 100, or edit the embroidery pattern and so on.

A thread compartment 18, which is a recessed portion that houses a thread spool 20, is provided in a generally central portion inside the arm portion 13. The arm portion 13 is provided with an opening-and-closing cover 16 that opens and closes the upper portion side of the arm portion 13. The thread compartment 18 is opened or concealed in accordance with the opening and closing of the opening-and-closing cover 16. A thread spool pin 19 is provided on an interior wall surface of the thread compartment 18 on the side of the pillar 12, the thread spool pin 19 protruding towards the head portion 14. The thread spool 20 is mounted in the thread compartment 18 in a state in which the thread spool pin 19 is inserted into an insertion hole (not shown in the figures) of the thread spool 20.

An upper thread (not shown in the figures) that extends from the thread spool 20 is supplied to a stitching needle 7 (refer to FIG. 2) that is mounted on the needle bar 6. The upper thread is supplied through a thread guide portion (not shown in the figures) provided in the head portion 14. The needle bar 6 is driven up and down by a needle bar up-and-down drive mechanism (not shown in the figures) provided in the head portion 14. The needle bar up-and-down drive mechanism is driven by a drive shaft (not shown in the figures), which is rotationally driven by a sewing machine motor 79 (refer to FIG. 3).

A plurality of operation switches 21 are provided on a lower portion of a front surface of the arm portion 13. The plurality of operation switches 21 include, for example, a sewing start-and-stop switch, a reverse stitch switch and a needle up-and-down switch. In addition, a speed controller 32 is provided in the center of the lower portion of the front surface of the arm portion 13. The speed controller 32 is an operation member for the user to adjust a rotation speed of the drive shaft.

The needle bar 6, the stitching needle 7, a presser bar 45 and a presser foot 47 will be explained with reference to FIG. 2. For explanatory ease, illustration of the embroidery frame 34 and the embroidery frame transport device 92 is omitted from FIG. 2. The needle bar 6 and the presser bar 45 are provided on the underside of the head portion 14. The stitching needle 7 is affixed to the bottom end of the needle bar 6. The presser bar 45 is raised and lowered between a raised position and a lowered position by a presser bar lifting lever (not shown in the figures). The presser foot 47 is fixed to the bottom end of the presser bar 45 by a screw 48. The presser foot 47 is a known presser foot for embroidery sewing that presses the work cloth 100. Further, on the underside of the head portion 14, a probe 50 is provided to the rear of the presser bar 45 and the presser foot 47 (to the left side in FIG. 2). The probe 50 is supported by a machine casing (not shown in the figures) of the head portion 14, and can be switched between an upward position, in which it is accommodated inside the head portion 14, and a downward position, in which it protrudes downward from the head portion 14. A position sensor 58 (refer to FIG. 3), which detects switching of the probe 50 from the upward position to the downward position, is provided close to the probe 50.

The probe 50 is provided with a tillable lever 51 and a main body 53. The tiltable lever 51 is a bar-shaped member that extends vertically downward from the main body 53. The tiltable lever 51 is supported by the main body 53 such that the tiltable lever 51 can tilt in response to external pressure from a circumferential direction. A contacting sphere 52 is provided on the bottom end of the tiltable lever 51. Although not shown in the figures, a retaining mechanism, which retains the tillable lever 51, and a detector, which detects the tilt of the tiltable lever 51, are provided on the main body 53. In a state in which an external pressure is not applied to the tiltable lever 51 or to the contacting sphere 52, the retaining mechanism holds the tiltable lever 51 in a vertically downwardly extending posture (a neutral posture). When external pressure is applied from a circumferential direction to the tillable lever 51 or to the contacting sphere 52, the tiltable lever 51 tilts in response to the external pressure. The detector detects that the tiltable lever 51 is tilted, and outputs a detection signal. When the external pressure is no longer applied, the tiltable lever 51 is returned to the neutral posture by the retaining mechanism.

In the present embodiment, when the user sets a sewable area, which will be explained later, the user moves the probe 50 from the upward position to the downward position. The downward position is a height position at which the contacting sphere 52 at the bottom end of the tiltable lever 51 can come into contact with inner walls (inner circumferential surfaces of the inner frame) of the embroidery frame 34. However, as the downward position is slightly above the work cloth 100, the contacting sphere 52 in the downward position does not come into contact with an upper surface of the work cloth 100. In the embroidery frame 34 shown in FIG. 9, inner circumferential surfaces formed by the long sides 34A and 34B, the short sides 34C and 34D and the corners 34E to 34H are inner walls 341 to 348, respectively. The user moves the presser bar 45 to the upward position by operating the presser bar lifting lever. In addition, the user loosens the screw 48 and removes the presser foot 47 from the presser bar 45, so that when the embroidery frame 34 is moved, it does not come into contact with the presser foot 47.

Figure 3:
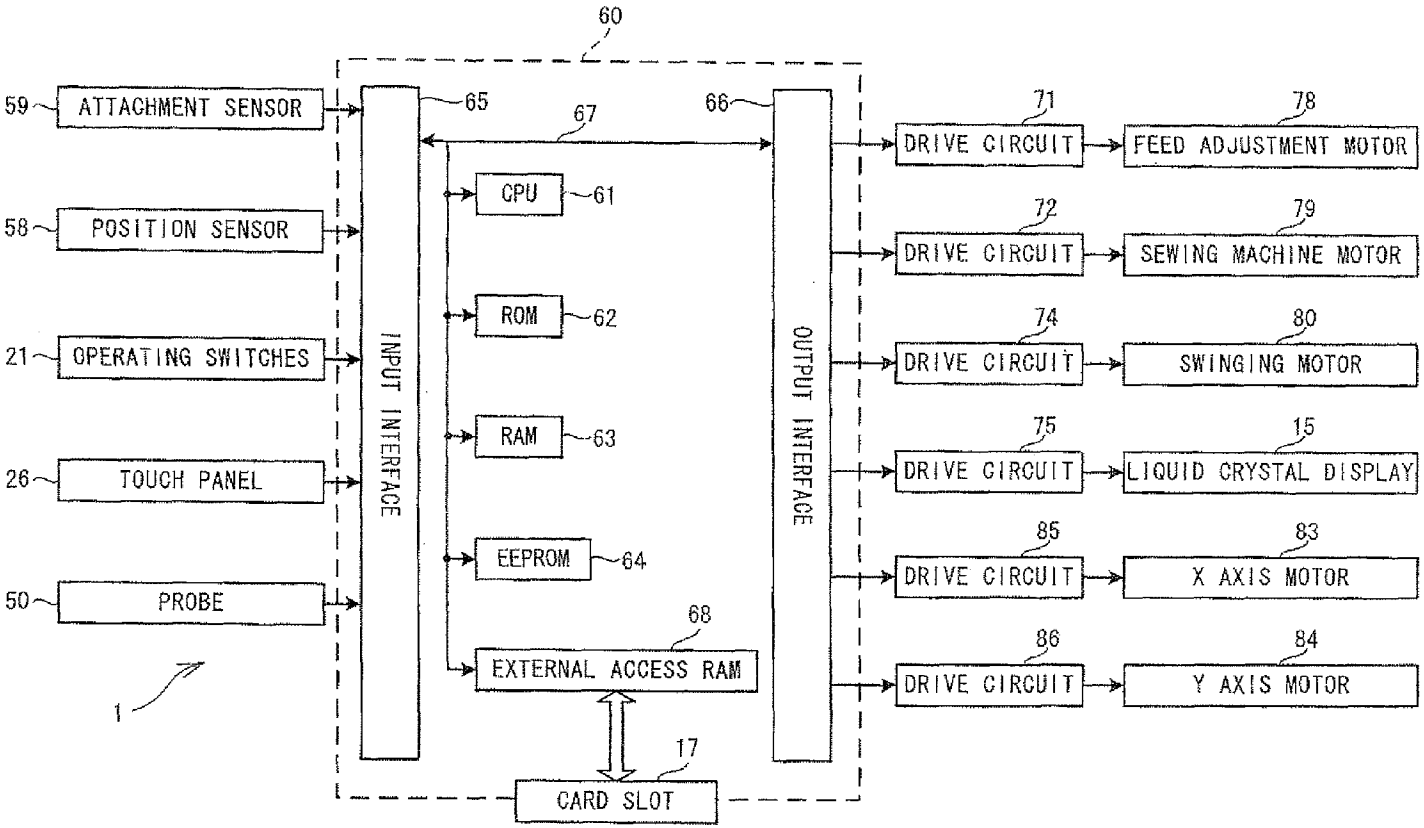
FIG. 3 is a block diagram showing an electrical configuration of the sewing machine 1.

An electrical configuration of the sewing machine 1 will be explained with reference to FIG. 3. A control portion 60 of the sewing machine 1 includes a CPU 61, a ROM 62, a RAM 63, an EEPROM 64, an external access RAM 68, an input interface 65 and an output interface 66, and these are connected to one another by a bus 67. A card slot 17, into which an external storage medium can removably be inserted, is connected to the external access RAM 68. The plurality of operating switches 21, the touch panel 26, the probe 50, an attachment sensor 59 and the position sensor 58 are connected to the input interface 65. The attachment sensor 59 is provided on the carriage of the embroidery frame transport device 92, and is a sensor that detects that the embroidery frame 34 is attached to the carriage. The CPU 61 performs various types of calculation and processing in accordance with a control program stored in the ROM 62. Furthermore, the CPU 61 determines whether the tiltable lever 51 is tilted, based on the detection signal output from the detector of the probe 50.

Drive circuits 71, 72, 74, 75, 85 and 86 are electrically connected to the output interface 66. The drive circuit 71 drives the feed adjustment motor 78 that is a pulse motor. The drive circuit 72 drives the sewing machine motor 79. The drive circuit 74 drives a swinging motor 80, which is a pulse motor that drives the needle bar 6 in a swinging motion. It should be noted that the feed adjustment motor 78 and the swinging motor 80 are not driven when the embroidery pattern is being sewn. The drive circuit 75 drives the liquid crystal display 15. The drive circuits 85 and 86 respectively drive the X axis motor 83 and the Y axis motor 84 that move the embroidery frame 34.

Area setting processing performed by the sewing machine 1 will be explained with reference to FIG. 4 to FIG. 15, while referring to flow charts. If the user performs a panel operation and selects, from among a plurality of embroidery patterns, an embroidery pattern to be sewn on the work cloth 100, the CPU 61 performs area setting processing (refer to FIG. 4) in accordance with the program stored in the ROM 62, to thereby set the sewable area of the embroidery frame 34. The sewable area is an area on which the embroidery pattern can be sewn on the inner side area of the embroidery frame 34, taking into consideration the roundness (the angle R) of the corners 34E to 34H of the embroidery frame 34.

Figure 4:
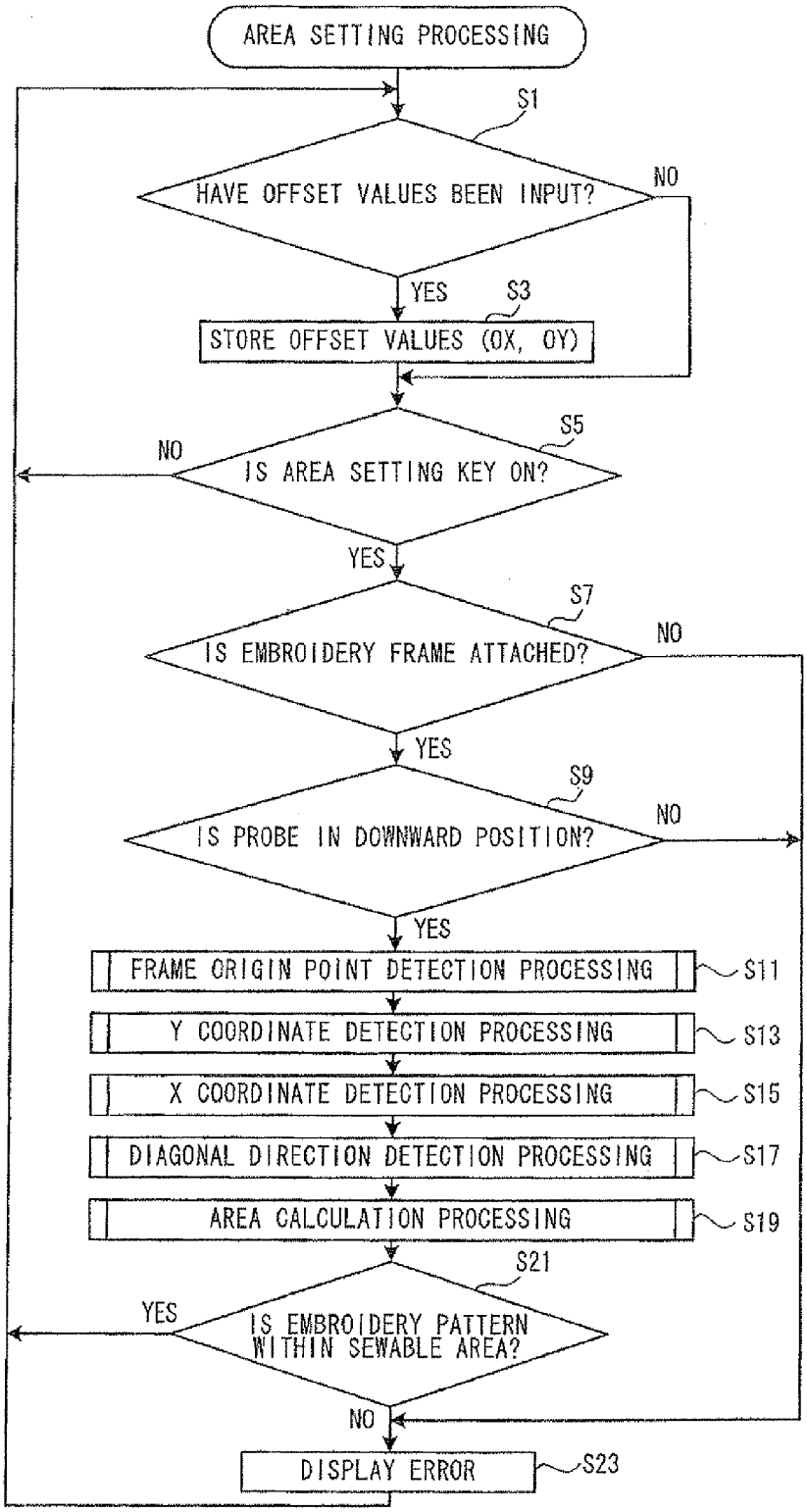
FIG. 4 is a flow chart of area setting processing.

As shown in FIG. 4, in the area setting processing, a determination is made as to whether offset values have been input (step S1). The offset values are correction values that scale up or scale down the sewable area. The user can perform a panel operation to input the offset values (OX, OY). In the present embodiment, it is possible to input the offset value (OX) that indicates a size by which the sewable area is scaled up or scaled down in the left-right direction (the X direction) and to input the offset value (OY) that indicates a size by which the sewable area is scaled up or scaled down in the front-rear direction (the Y direction).

When the offset values have been input (yes at step S1), the input offset values are stored in the EEPROM 64 (step S3). After performing step S3, or when the offset values have not been input (no at step S1), a determination is made as to whether an area setting key is on (step S5). The area setting key is a key to input a command that sets the sewable area of the embroidery frame 34. More specifically, when the user performs a panel operation to depress the area setting key displayed on the liquid crystal display 15, it is determined that the area setting key is on (yes at step S5).

Next, using the signal from the attachment sensor 59, a determination is made as to whether the embroidery frame 34 is attached to the carriage of the embroidery frame transport device 92 (step S7). When the embroidery frame 34 is not attached to the carriage (no at step S7), an error message indicating that the embroidery frame 34 is not attached is displayed on the liquid crystal display 15 (step S23). After performing step S23, the processing returns to step S1.

When the embroidery frame 34 is attached to the carriage of the embroidery frame transport device 92 (yes at step S7), based on an output signal of the position sensor 58, a determination is made as to whether the probe 50 is in the downward position (step S9). When the probe 50 is not in the downward position (no at step S9), an error message indicating that the probe 50 is not in the downward position is displayed on the liquid crystal display 15 (step S23). After performing step S23, the processing returns to step S1.

When the probe 50 is in the downward position (yes at step S9), frame origin point detection processing (step S11), Y coordinate detection processing (step S13), X coordinate detection processing (step S15), diagonal direction detection processing (step S17) and area calculation processing (step S19) are sequentially performed. Hereinafter, each of the processes will be explained individually in detail.

Figure 5:
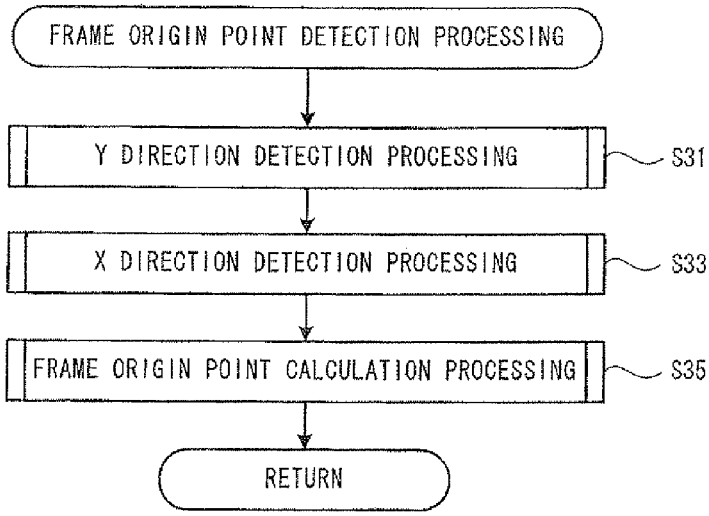
FIG. 5 is a flow chart of frame origin point detection processing (step S11)
Figure 6:
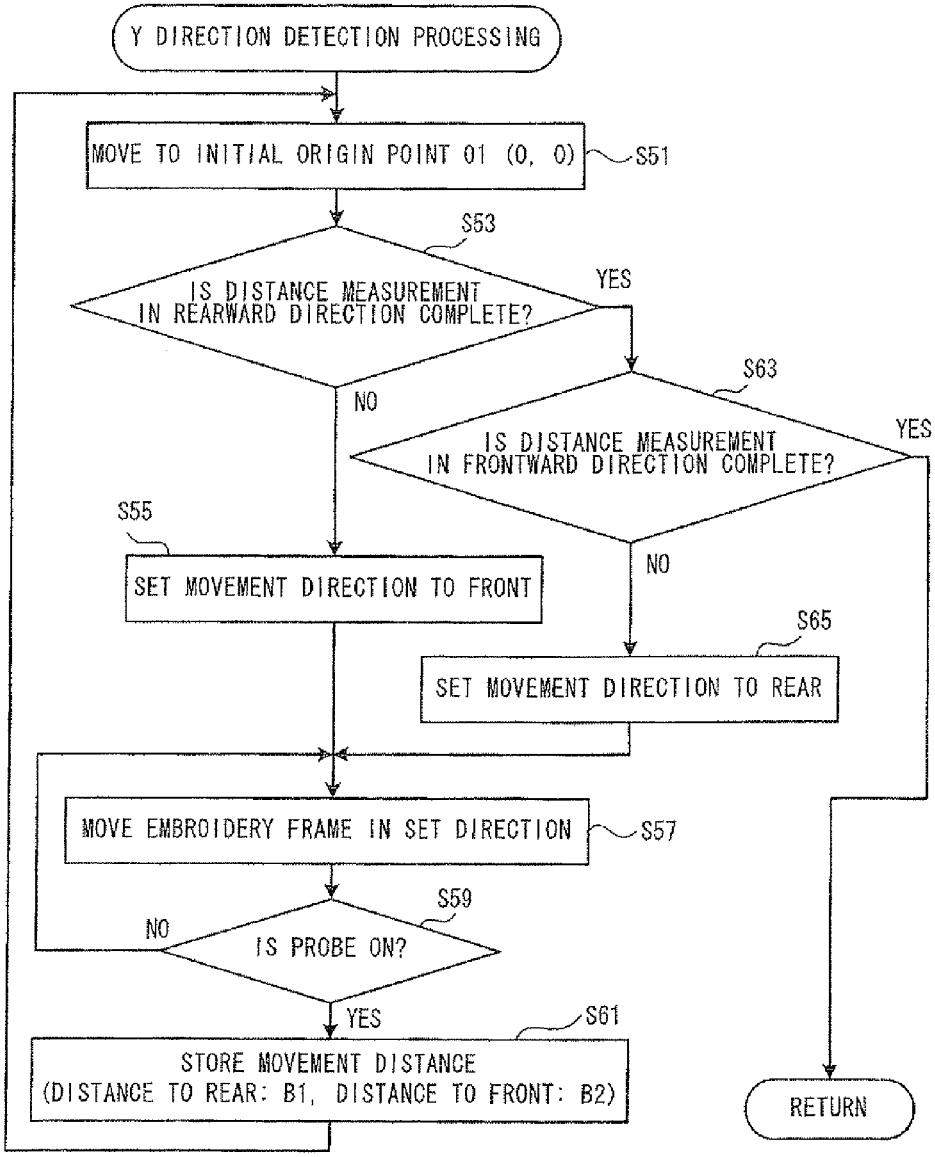
FIG. 6 is a flow chart of Y direction detection processing (step S31)

As shown in FIG. 5, in the frame origin point detection processing (step S11), Y direction detection processing (step S31) Shown in FIG. 6 is performed. In the Y direction detection processing (step S31), first, by moving the carriage of the embroidery frame transport device 92 to an initial position, the embroidery frame 34 attached to the carriage is also moved to the initial position (step S51). Here, the initial position refers to a reference position of the carriage when power to the embroidery frame transport device 92 is switched on. When the embroidery frame 34 is in the initial position, the tiltable lever 51 is in the neutral posture and position coordinates of the contacting sphere 52 are an initial origin point O1 (0, 0), as shown in FIG. 9. The position coordinates of the contacting sphere 52 are coordinates of a center position (namely a position in the front-rear and left-right directions) of the contacting sphere 52, in a plan view.

After performing step S51, a determination is made as to whether a measurement is complete of a distance in the rearward direction from the initial origin point O1 of the embroidery frame 34 (step S53). When the distance in the rearward direction has not yet been measured (no at step S53), "front" is set as a movement direction of the embroidery frame 34 (step S55). In the sewing machine 1, the embroidery frame 34 moves in the front-rear and the left-right directions with respect to the probe 50, whose position in the front-rear and left-right directions is fixed. As a result, at step S55, in order to measure the rearward direction distance of the embroidery frame 34, settings are made to move the embroidery frame 34 in the frontward direction.

After performing step S55, the embroidery frame 34 is moved in the set direction by the embroidery frame transport device 92 (step S57). Then, a determination is made as to whether the probe 50 is on (step S59). More specifically, based on the detection signal output from the detector of the probe 50, a determination is made as to whether the tiltable lever 51 is tilted. When the tiltable lever 51 is tilted, it is determined that the probe 50 is on (yes at step S59).

In this case, the movement of the embroidery frame 34 is stopped, and a movement distance from the initial origin point O1 to the stop position is identified and stored in the RAM 63 (step S61). After that, the processing returns to step S51. On the other hand, when the probe 50 is off (no at step S59), the processing returns to step S57. Thus, the embroidery frame 34 is moved in the set direction until the probe 50 is on.

In the present embodiment, when "front" is set as the movement direction of the embroidery frame 34 (step S55), the embroidery frame 34 that is at the initial origin point O1 is moved in the frontward direction (step S57). As the embroidery frame 34 is moved in the frontward direction, a distance between the contacting sphere 52, which is disposed on the inner side of the embroidery frame 34, and the inner wall 343 (refer to FIG. 9) at the rear of the embroidery frame 34 gradually becomes smaller, and the contacting sphere 52 comes into contact with the inner wall 343. At that time the tillable lever 51 is tilted and it is thus determined that the probe 50 is on (yes at step S59). A distance B1 (refer to FIG. 9) that the embroidery frame 34 is moved in the frontward direction is stored in the RAM 63 (step S61).

After performing step S51, when it is determined that the measurement is complete of the distance in the rearward direction from the initial origin point O1 (yes at step S53), a determination is made as to whether a measurement is complete of a distance in the frontward direction from the initial origin point O1 (step S63). When the distance in the frontward direction has not yet been measured (no at step S63), "rear" is set as the movement direction of the embroidery frame 34 (step S65). Following that, the above-described step S57 to step S61 are performed, and the processing returns to step S51.

In the present embodiment, when "rear" is set as the movement direction of the embroidery frame 34 (step S65), the embroidery frame 34 that is at the initial origin point O1 is moved in the rearward direction (step S57). As the embroidery frame 34 is moved in the rearward direction, the contacting sphere 52 comes into contact with the inner wall 344 (refer to FIG. 9) at the front of the embroidery frame 34 and the probe 59 is on (yes at step S59). A distance B2 that the embroidery frame 34 is moved in the rearward direction (refer to FIG. 9) is stored in the RAM 63 (step S61).

After performing step S51, when measurement is complete of both the distances in the rearward and frontward directions from the initial origin point O1 (yes at step S53 and yes at step S63), the processing returns to the frame origin point detection processing (refer to FIG. 5). As shown in FIG. 5, after performing step S31, X direction detection processing (step S33) is performed.

Figure 7:
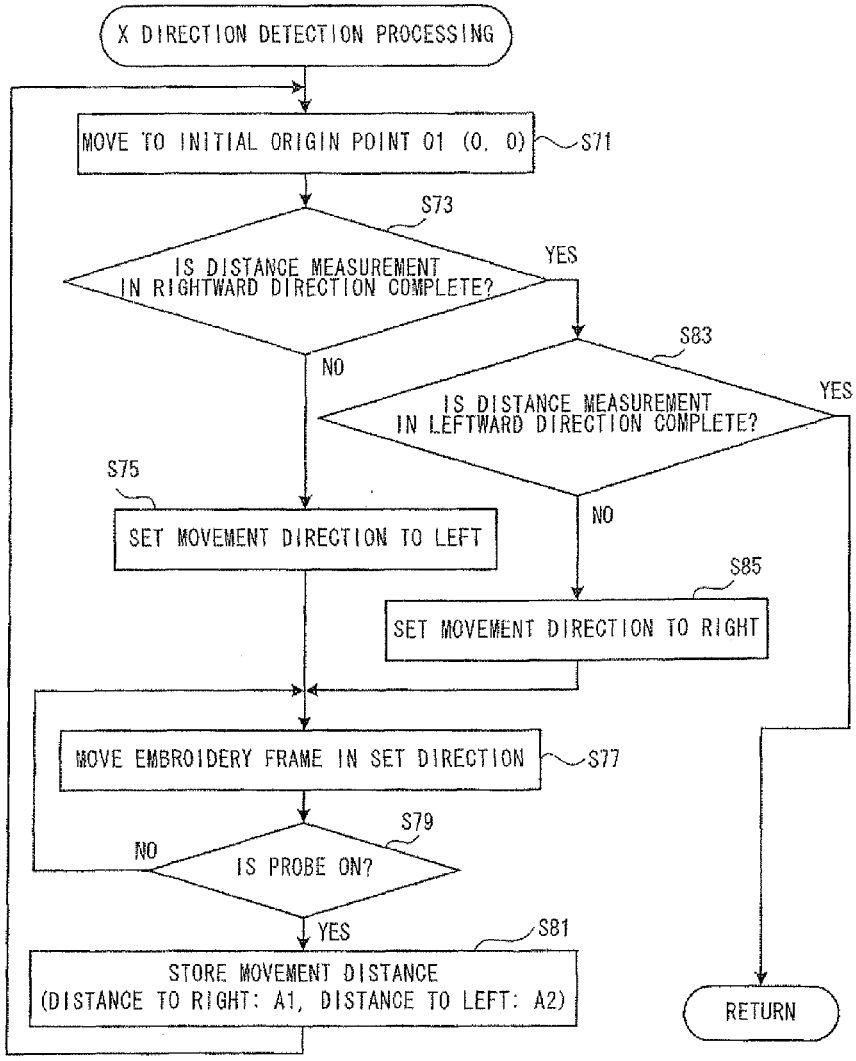
FIG. 7 is a flow chart of X direction detection processing (step S33)

As shown in FIG. 7, in the X direction detection processing (step S33), the embroidery frame 34 is moved to the initial origin point O1 (step S71). Next, a determination is made as to whether a measurement is complete of a distance in the rightward direction of the embroidery frame 34 (step S73). When the distance in the rightward direction has not yet been measured (no at step S73), "left" is set as the movement direction of the embroidery frame 34 (step S75). The reason for this is the same as in the case of moving the embroidery frame 34 in the frontward and rearward directions.

After performing step S75, the embroidery frame 34 is moved by the embroidery frame transport device 92 in the set direction (step S77). Then, a determination is made as to whether the probe 50 is on (step S79). When the probe 50 is on (yes at step S79), the movement distance from the initial origin point O1 to the stop position is stored (step S81). Following that, the processing returns to step S71. On the other hand, when the probe 50 is off (no at step S79), the processing returns to step S77.

In the present embodiment, when "left" is set as the movement direction of the embroidery frame 34 (step S75), the embroidery frame 34 that is at the initial origin point O1 is moved in the leftward direction (step S77). As the embroidery frame 34 is moved in the leftward direction, the contacting sphere 52 comes into contact with the right side inner wall 341 (refer to FIG. 9) and the probe 50 is on (yes at step S79). A distance A1 (refer to FIG. 9) that the embroidery frame 34 is moved in the leftward direction is stored in the RAM 63 (step S81).

After executing step S71, when the measurement of the distance in the rightward direction is complete (yes at step S73), a determination is made as to whether a measurement is complete of a distance in the leftward direction of the embroidery, frame 34 (step S83). When the distance in the leftward direction has not yet been measured (no at step S83), "right" is set as the movement direction of the embroidery frame 34 (step S85). Following that, the above-described step S77 to step S81 are performed, and the processing returns to step S71.

In the present embodiment, when "right" is set as the movement direction of the embroidery frame 34 (step S85), the embroidery frame 34 that is at the initial origin point O1 is moved in the rightward direction (step S77). As the embroidery frame 34 is moved in the rightward direction, the contacting sphere 52 comes into contact with the left side inner wall 342 (refer to FIG. 9), and the probe 50 is on (yes at step S79). A distance A2 (refer to FIG. 9) that the embroidery frame 34 is moved in the rightward direction is stored in the RAM 63 (step S81).

After performing step S71, when measurement is complete of both the distances in the leftward and rightward directions (yes at step S73 and yes at step S83), the processing returns to the frame origin point detection processing (refer to FIG. 5). As shown in FIG. 5, after performing step S33, frame origin point calculation processing (step S35) is performed.

Figure 8:
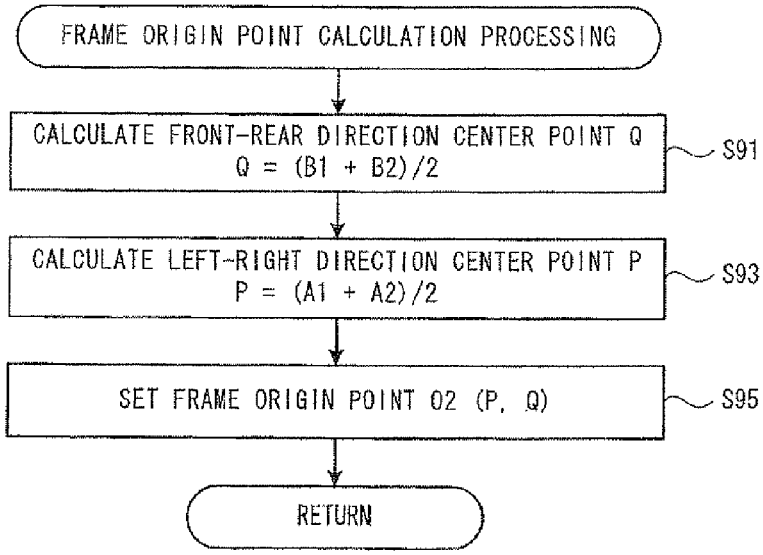
FIG. 8 is a flow chart of frame origin point calculation processing (step S35)

As shown in FIG. 8, in the frame origin point calculation processing (step S35), a center point Q in the front-rear direction of the embroidery frame 34 is calculated (step S91). The center point Q is calculated in the following manner, based on the distances B1 and B2 stored in the RAM 63.

$$Q=(B1+B2)/2$$

After performing step S91, a center point P in the left-right direction of the embroidery frame 34 is calculated (step S93). The center point P is calculated in the following manner, based on the distances A1 and A2 stored in the RAM 63.

$$P=(A1+A2)/2$$

The center point Q calculated at step S91 and the center point P calculated at step S93 are set as coordinates (P, Q) of a frame origin point O2 (step S95). The frame origin point O2 is a center position in the front-rear direction (the Y direction) and the left-right direction (the X direction) of the embroidery frame 34 (refer to FIG. 9). After this, the processing returns to the frame origin point detection processing (FIG. 5) and further the processing returns to the area setting processing (FIG. 4).

Figure 10:
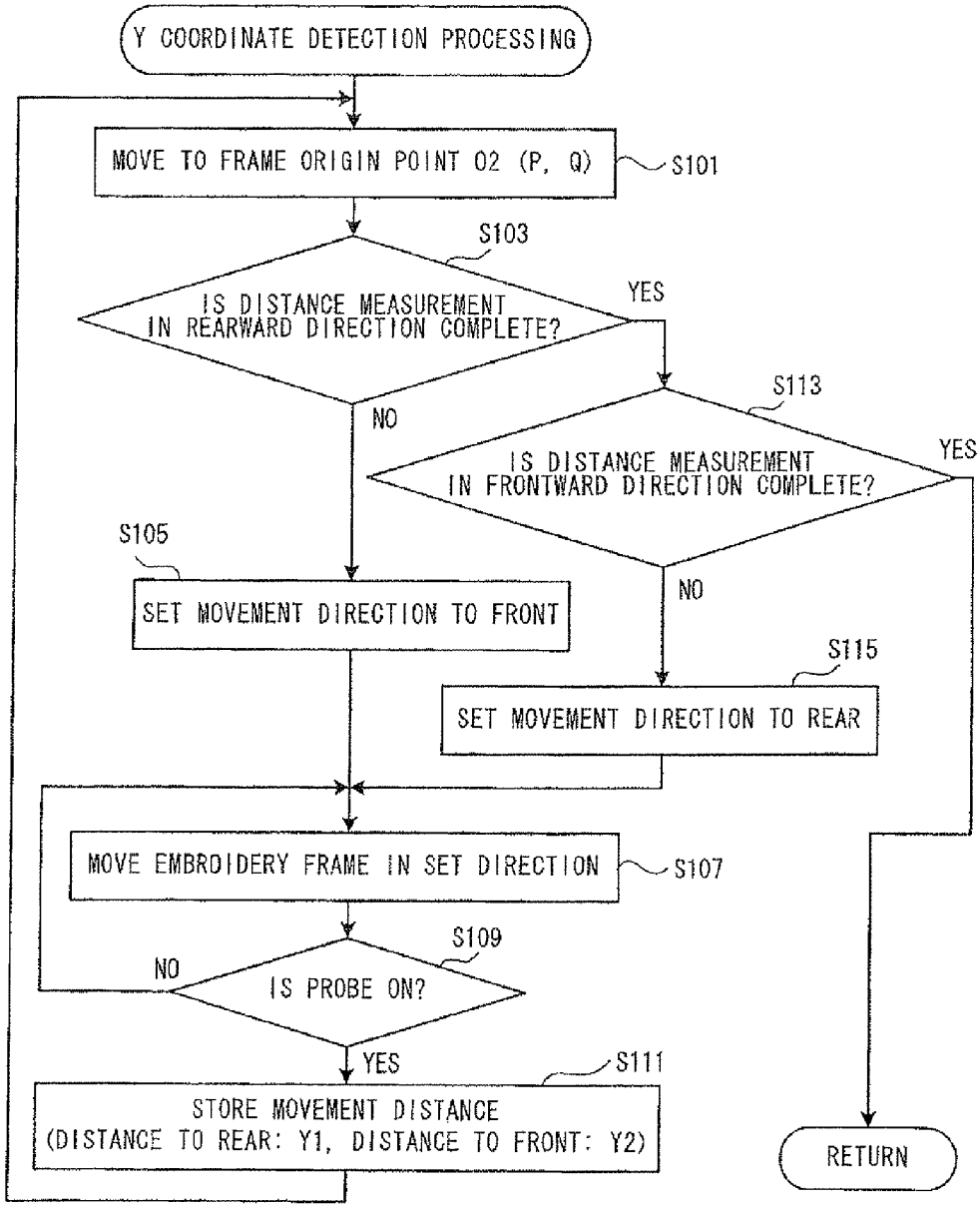
FIG. 10 is a flow chart of Y coordinate detection processing (step S13)

As shown in FIG. 10, in the Y coordinate detection processing (step S13), the embroidery frame 34 is moved until the position of the contacting sphere 52 is aligned with the frame origin point O2 (step S101). In other words, the embroidery frame 34 is moved until the position coordinates of the contacting sphere 52 match the frame origin point O2 (P, Q). Following that, processing is performed (step S103 to step S115), which is similar to the processing at step S53 to step S65 of the Y direction detection processing (FIG. 6).

In the present embodiment, by the processing at step S105 to step S111, a distance Y1 (refer to FIG. 13) is detected, which is a distance in which the embroidery frame 34 is moved in the frontward direction, taking the frame origin point O2 as a reference point. The distance Y1 is stored in the RAM 63. By the processing at step S115, and at step S107 to step S111, a distance Y2 (refer to FIG. 13) is detected, which is a distance that the embroidery frame 34 is moved in the rearward direction, taking the frame origin point O2 as the reference point. The distance Y2 is stored in the RAM 63. The distances Y1 and Y2 indicate Y coordinates at which the contacting sphere 52 of the tiltable lever 51 of the probe 50 comes into contact with the inner wall 343 and the inner wall 344, respectively.

Figure 11:
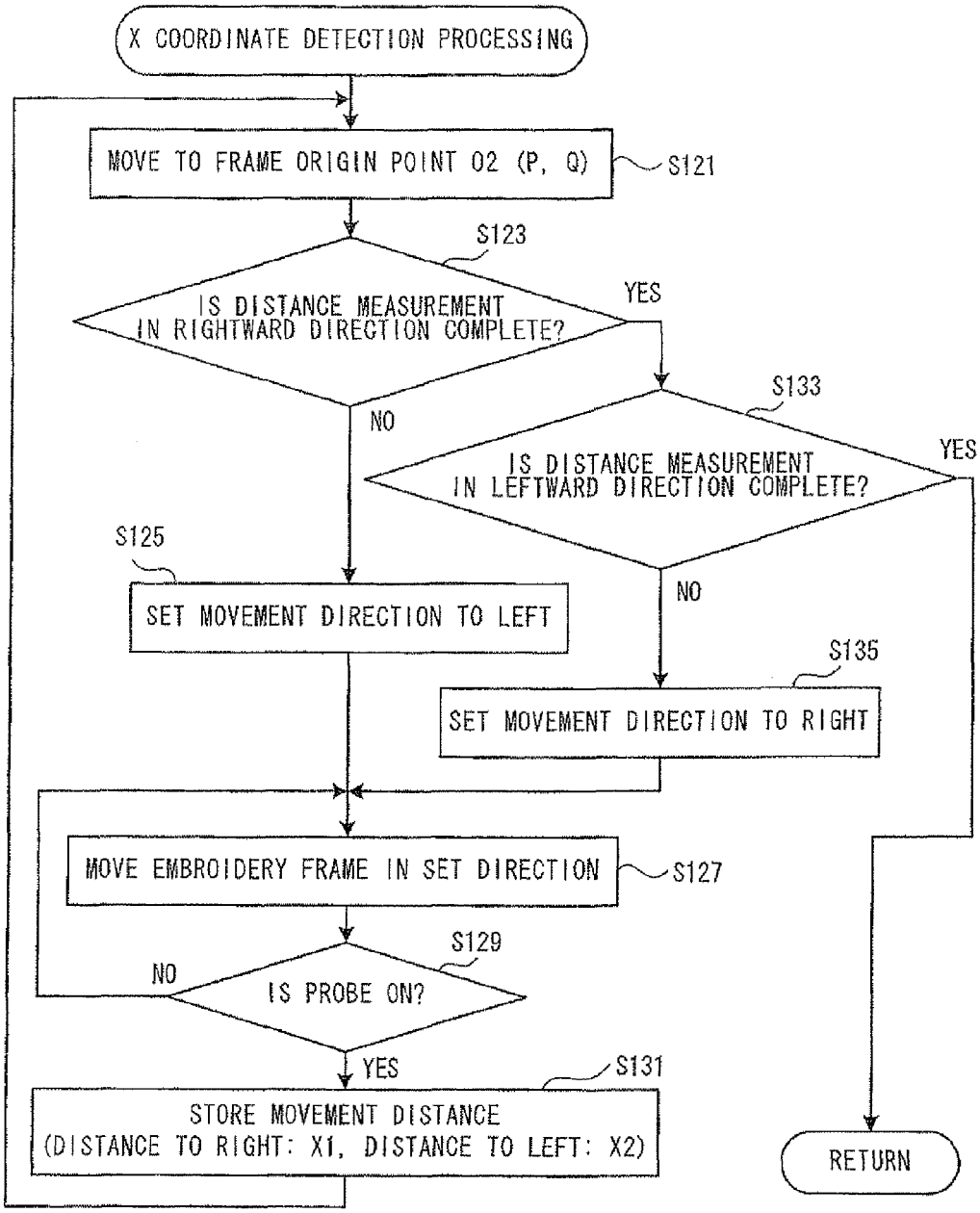
FIG. 11 is a flow chart of X coordinate detection processing (step S15)

As shown in FIG. 11, in the X coordinate detection processing (step S15), the embroidery frame 34 is moved until the position coordinates of the contacting sphere 52 are aligned with the frame origin point O2 (P, Q) (step S121). Following that, processing is performed (step S123 to step S135), which is similar to the processing at step S73 to step S85 of the X direction detection processing (FIG. 7).

In the present embodiment, by the processing at step S125 to step S131, a distance X1 (refer to FIG. 13) is detected, which is a distance in which the embroidery frame 34 is moved in the leftward direction, taking the frame origin point O2 as the reference point. The distance X1 is stored in the RAM 63. By the processing at step S135, and at step S127 to step S131, a distance X2 (refer to FIG. 13) is detected, which is a distance that the embroidery frame 34 is moved in the rightward direction, taking the frame origin point O2 as the reference point. The distance X2 is stored in the RAM 63. The distances X1 and X2 indicate X coordinates at which the contacting sphere 52 comes into contact with the inner wall 341 and the inner wall 342, respectively.

Figure 12:
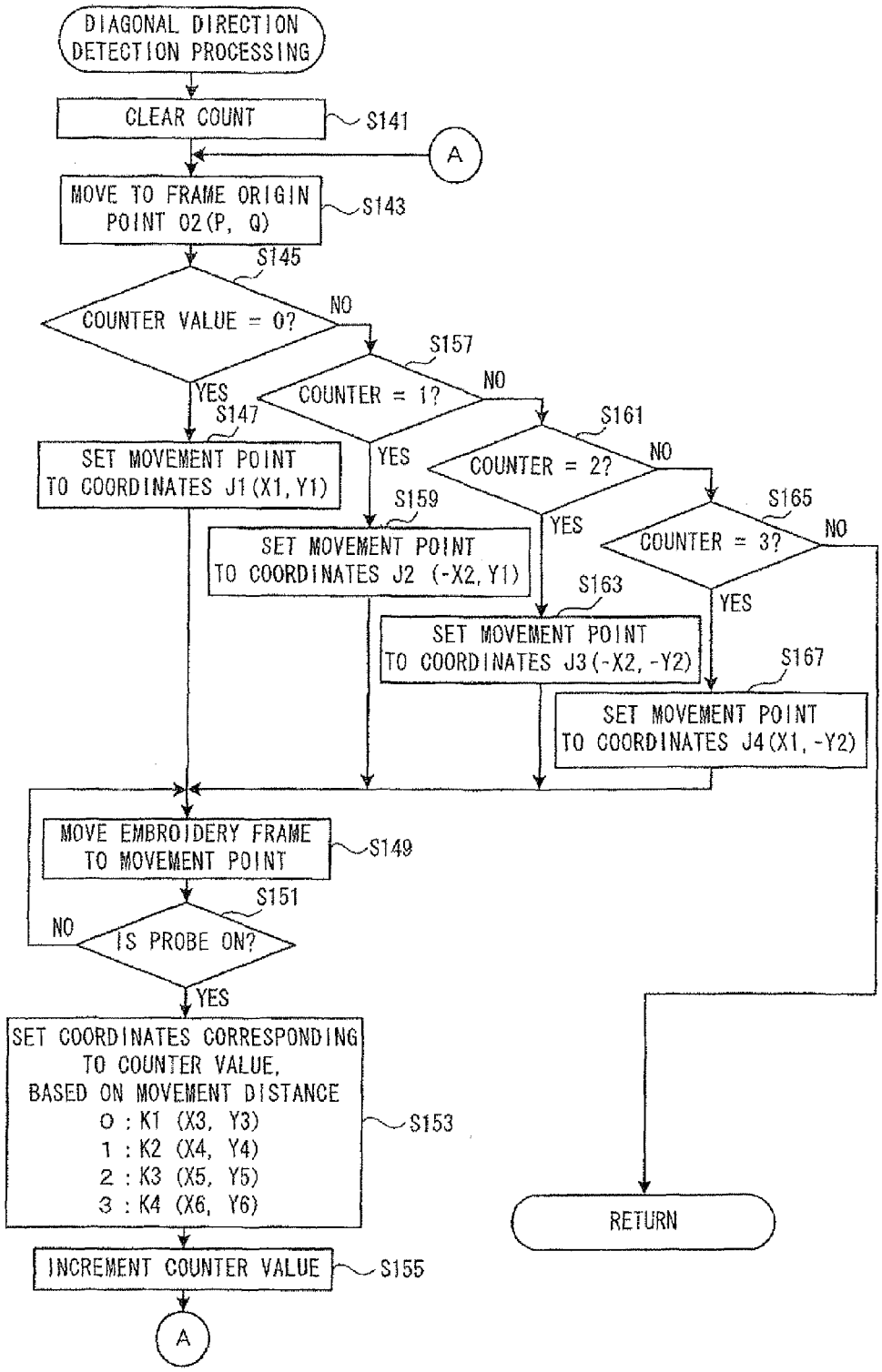
FIG. 12 is a flow chart of diagonal direction detection processing (step S17)

As shown in FIG. 12, in the diagonal direction detection processing (step S17), a counter value that is stored in the RAM 63 is reset to "0" (step S141). The embroidery frame 34 is moved until the position coordinates of the contacting sphere 52 match the frame origin point O2 (F, Q) (step S143). Next, a determination is made as to whether the counter value is "0" (step S145). When the counter value is "0" (yes at step S145), the coordinates J1 (X1, Y1) are set as a movement point stored in the RAM 63 (step S147). The X coordinate and the Y coordinate of the coordinates J1 are the distance X1 and the distance Y1, respectively, which are stored in the RAM 63 (refer to FIG. 13).

The movement point is a vertex of a first virtual rectangle 200 (refer to FIG. 13) that is calculated from the distances Y1 and Y2 detected in the Y coordinate detection processing (step S13) and the distances X1 and X2 detected in the X coordinate detection processing (step S15). Thus, a direction toward the movement point from the frame origin point O2 is equivalent to a direction of a diagonal line of the first virtual rectangle 200.

After performing step S147, the embroidery frame 34 is moved by the embroidery frame transport device 92 to the movement point stored in the RAM 63 (step S149). Then, a determination is made as to whether the probe 50 is on (step S151). When the probe 50 is on (yes at step S151), based on the movement distance from the frame origin point O2 to the stop position, one of sets of coordinates K1, K2, K3 and K4 corresponding to the counter value is set and stored in the RAM 63 (step S153). Following that, the counter value is incremented (step S155), and the processing returns to step S143. On the other hand, when the probe 50 is off (no at step S151), the processing returns to step S149, and the embroidery frame 34 is moved toward the movement point until the probe 50 is on.

In the present embodiment, immediately after starting the diagonal direction detection processing (step S17), the counter value is set to "0" (step S143, yes at step S145). In this case, the embroidery frame 34 is moved from the frame origin point O2 toward the coordinates J1 (X1, Y1), namely, the embroidery frame 34 is moved in the front left direction (yes at step S145; step S147 and step S149). When the contacting sphere 52 comes into contact with the inner wall 345 (refer to FIG. 13) of the corner 34E (yes at step S151), based on the distance that the embroidery frame 34 has been moved (namely, the movement distance in the X direction and the Y direction, taking the frame origin point O2 as the reference point), the coordinates K1 (X3, Y3) corresponding to the counter value "0" are set (step S153).

After performing step S143, when the counter value is not "0" (no at step S145), a determination is made as to whether the counter value is "1" (step S157). When the counter value is "1" (yes at step S157), coordinates J2 (−X2, Y1) are set as the movement point stored in the RAM 63 (step S159). The X coordinate and the Y coordinate of the coordinates J2 are the minus value of the distance X2 and the distance Y1, respectively, which are stored in the RAM 63 (refer to FIG. 13). Following this, step S149 to step S155 are performed and the processing returns to step S143.

In the present embodiment, after the coordinates K1 (X3, Y3) have been set, the counter value is set to "1" (step S155). In this case, the embroidery frame 34 is moved from the frame origin point O2 toward the coordinates J2 (−X2, Y1). Namely, the embroidery frame 34 is moved in the front right direction (yes at step S157; step S159 and step S149). When the contacting sphere 52 comes into contact with the inner wall 346 (refer to FIG. 13) of the corner 34F (yes at step S151), based on the distance that the embroidery frame 34 has been moved, the coordinates K2 (X4, Y4) corresponding to the counter value "1" are set (step S153).

After performing step S143, when the counter value is neither "0" nor "1" (no at step S145 and no at step S157), a determination is made as to whether the counter value is "2" (step S161). When the counter value is "2" (yes at step S161), coordinates J3 (−X2, −Y2) are set as the movement point stored in the RAM 63 (step S163). The X coordinate and the Y coordinate of the coordinates J3 are the minus value of the distance X2 and the minus value of the distance Y2, respectively (refer to FIG. 13), which are stored in the RAM 63. Following this, step S149 to step S155 are performed and the processing returns to step S143.

In the present embodiment, after the coordinates K2 (X4, Y4) have been set, the counter value is set to "2" (step S155). In this case, the embroidery frame 34 is moved from the frame origin point O2 toward the coordinates J3 (−X2, −Y2). Namely, the embroidery frame 34 is moved in the rear right direction (yes at step S161; step S163 and step S149). When the contacting sphere 52 comes into contact with the inner wall 347 (refer to FIG. 13) of the corner 34G (yes, at step S151), based on the distance that the embroidery frame 34 has been moved, the coordinates K3 (X5, Y5) corresponding to the counter value "2" are set (step S153).

After performing step S143, when the counter value is neither "0", "1", nor "2" (no at step S145; no at step S157 and no at step S161), a determination is made as to whether the counter value is "3" (step S165). When the counter value is "3" (yes at step S165), coordinates J4 (X1, −Y2) are set as the movement point stored in the RAM 63 (step S167). The X coordinate and the Y coordinate of the coordinates J4 are the distance X1 and the minus value of the distance Y2, respectively, which are stored in the RAM 63 (refer to FIG. 13). Following this, step S149 to step S155 are performed and the processing returns to step S143.

In the present embodiment, after the coordinates K3 (X5, Y5) have been set, the counter value is set to "3" (step S155). In this case, the embroidery frame 34 is moved from the frame origin point O2 toward the coordinates J4 (X1, −Y2). Namely, the embroidery frame 34 is moved in the rear left direction (yes at step S165; step S167 and step S149). When the contacting sphere 52 comes into contact with the inner wall 348 (refer to FIG. 13) of the corner 34H (yes at step S151), based on the distance that the embroidery frame 34 has been moved, the coordinates K4 (X6, Y6) corresponding to the counter value "3" are set (step S153).

After performing step S143, when the counter value is neither "0", "1", "2" nor "3" (no at step S145; no at step S157; no at step S161 and no at step S165), the processing returns to the area setting processing (FIG. 4). In the present embodiment, after the coordinates K4 (X6, Y6) have been set, the counter value is set to "4" (step S155) and the determination is thus made that the counter value is not "3" (no at step S165). In other words, after all the coordinates K1 to K4 have been set, the diagonal direction detection processing (step S17) is ended.

Figure 14:
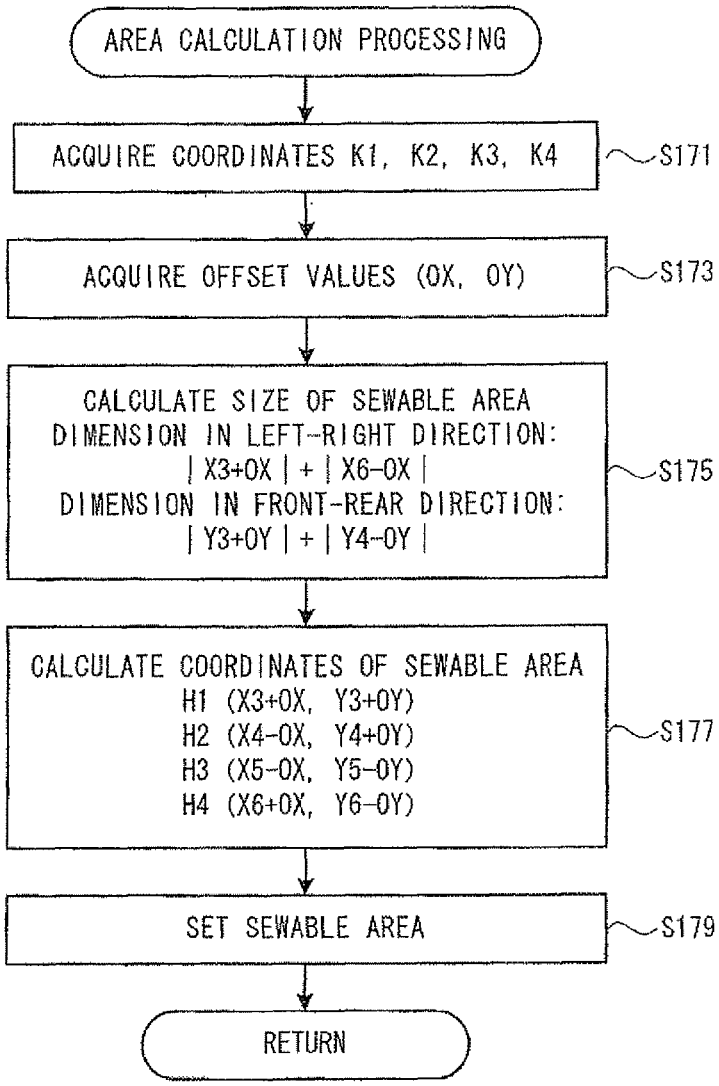
FIG. 14 is a flow chart of area calculation processing (step S19)

As shown in FIG. 14, in the area calculation processing (step S19), the coordinates K1 to K4 stored in the RAM 63 are acquired (step S171). Note that a second virtual rectangle, which has the coordinates K1 to K4 as its vertices, is a sewable area before scaling up or scaling down based on the offset values (namely, is a pre-correction sewable area 201) (refer to FIG. 15).

The offset values (OX, OY) stored in the EEPROM 64 are acquired (step S173). Based on the coordinates K1 to K4 and the offset values (OX, OY), a size of the sewable area is calculated (step S175). Of the dimensions of the sewable area, a dimension T1 in the left-right direction is calculated in the following manner:

$$T1=|X3+OX|+|X6-OX| \text{(Alternatively: } T1=|X4+OX|+|X5-OX|\text{)}$$

Of the dimensions of the sewable area, a dimension T2 in the front-rear direction is calculated in the following manner:

$$T2=|Y3+OY|+|Y4-OY| \text{(Alternatively: } T2=|Y5-OY|+|Y6+OY|\text{)}$$

Based on the coordinates K1 to K4 and the offset values (OX, OY), coordinates H1, H2, H3 and H4, which are four vertices that form the sewable area, are calculated (step S177). Specifically, the coordinates H1 (X3+OX, Y3+OY) are calculated based on the coordinates K1 (X3, Y3) and the offset values (OX, OY). The coordinates H2 (X4−OX, Y4+OY) are calculated based on the coordinates K2 (X4, Y4) and the offset values (OX, OY). The coordinates H3 (X5−OX, Y5−OY) are calculated based on the coordinates K3 (X5, Y5) and the offset values (OX, OY). The coordinates H4 (X6−OX, Y6−OY) are calculated based on the coordinates K4 (X6, Y6) and the offset values (OX, OY).

A virtual rectangle that has the coordinates H1 to H4 as its vertices is set as the sewable area (step S179). The sewable area set at step S179 is associated with a type of the embroidery frame 34 and with component names etc. and is stored in the EEPROM 64. Following that, the processing returns to the area setting processing (FIG. 4).

Figure 15:
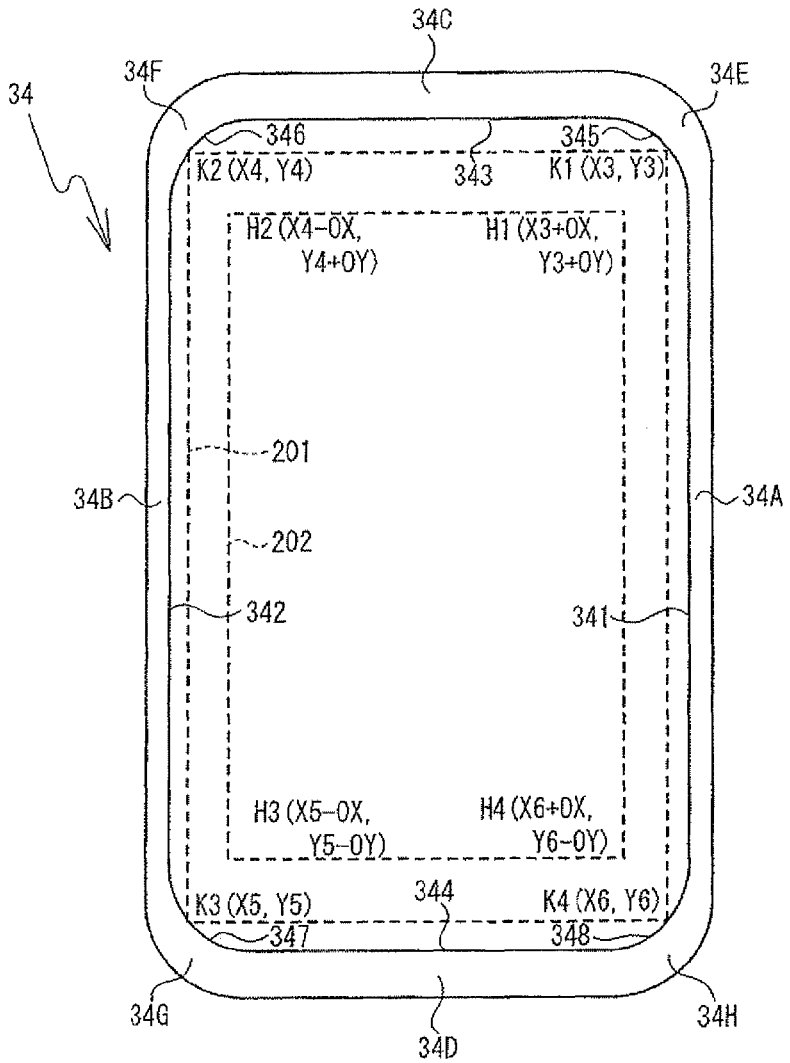
FIG. 15 is a plan view of the embroidery frame 34, showing the coordinates K1 to K4 and coordinates H1 to H4.

It is assumed, for example, that the user sets the offset values (−3 mm, −5 mm) (yes at step S1; step S3). In this case, as shown in FIG. 15, as a size of a post-correction sewable area 202, a size is calculated in which the pre-correction sewable area 201 is scaled down by 3 mm in each of the up and down directions, and by 5 mm in each of the left and right directions (step S175). Further, as the coordinates H1 to H4 of the post-correction sewable area 202, values are calculated such that the offset values (−3 mm, −5 mm) are reflected in each of the coordinates K1 to K4 (step S177). In other words, the post-correction sewable area 202 is set to be a rectangle that is scaled down toward an inner side direction of the pre-correction sewable area 201.

It should be noted that, when the user has not set the offset values (no at step S1), (0, 0) are acquired as the offset values (OX, OY) at step S173. In this case, the pre-correction sewable area 201 is set as the sewable area at step S179.

As shown in FIG. 4, after performing step S19, a determination is made as to whether the embroidery pattern selected by the user is within the sewable area (step S21). Namely, a determination is made as to whether the embroidery pattern is contained within the sewable area set at step S179. More specifically, when a size of the embroidery pattern (specifically, at least one of a dimension in the front-rear direction and a dimension in the left-right direction) is larger than a size of the sewable area, it is determined that the embroidery pattern is not contained within the sewable area (no at step S21). Even when the size of the embroidery pattern is equal to or less than the size of the sewable area, when at least a part of the embroidery pattern is arranged in a position that is outside the sewable area, it is determined that the embroidery pattern is not contained within the sewable area (no at step S21).

In this type of case, an error message indicating that the embroidery pattern is not contained within the sewable area is displayed on the liquid crystal display 15 (step S23). Note that the user can cause the embroidery pattern to be contained within the sewable area by performing a panel operation to change the size and position of the embroidery pattern. When the embroidery pattern is contained within the sewable area (yes at step S21), or after performing step S23, the processing returns to step S1.

After the sewable area has been set by the above-described area setting processing (FIG. 4), the user attaches the presser foot 47 to the presser bar 45 and fixes it using the screw 48. When the user depresses the sewing start-and-stop switch from among the plurality of operating switches 21, a sewing operation of the embroidery pattern by the sewing machine 1 is started. In this sewing operation, the embroidery pattern is sewn onto the work cloth 100 such that the embroidery pattern is contained within the sewable area of the embroidery frame 34. As a result, the presser foot 47 is inhibited from coming into contact with the corners 34E to 34H of the embroidery frame 34, and the embroidery pattern is sewn accurately onto the work cloth 100.

As described above, according to the sewing machine 1 of the present embodiment, by moving the embroidery frame 34 in the front-rear direction, Y coordinates are identified at which the contacting sphere 52 of the tillable lever 51 of the probe 50 comes into contact with the embroidery frame 34. By moving the embroidery frame 34 in the left-right direction, X coordinates are identified at which the contacting sphere 52 of the tiltable lever 51 of the probe 50 comes into contact with the embroidery frame 34. Directions from the frame origin point O2 to the movement points (the coordinates J1 to J4) are determined. The determined directions are diagonal lines of a first virtual rectangle that is calculated from these X coordinates and Y coordinates. By moving the embroidery frame 34 from the frame origin point O2 toward each of the movement points, the coordinates K1 to K4 are identified at which the contacting sphere 52 of the tiltable lever 51 of the probe 50 comes into contact with the embroidery frame 34. A second virtual rectangle, which is calculated from the coordinates K1 to K4, is set as the sewable area.

In other words, the corners 34E to 34H of the embroidery frame 34 are detected by moving the embroidery frame 34 from the frame origin point O2 toward each of the movement points (the coordinates J1 to J4), and the sewable area is set based on the detected corners 34E to 34H. Thus, even when the corners 34E to 34H of the embroidery frame 34 are arc-shaped, it is possible to set an appropriate sewable area. In addition, as the size of the sewable area is scaled up or scaled down in accordance with the offset values (OX, OY), the sewable area can be optimized in accordance with the user's needs. Furthermore, as the user is notified as to whether the embroidery pattern is contained within the sewable area, the user can easily ascertain whether it is possible to sew the accurate embroidery pattern onto the work cloth 100.

It should be noted that the present disclosure is not limited to the above-described embodiment, and various modifications may be made without departing from the spirit and scope of the present disclosure.

For example, in the above-described embodiment, the sewable area of the embroidery frame 34 is calculated in the area setting processing (FIG. 4), but alternatively, an already calculated sewable area may be acquired. For example, in a case in which a sewable area corresponding to the embroidery frame 34 that is provided as standard with the sewing machine 1 is stored in the EEPROM 64, step S11 to step S17 are skipped. At step S19, the sewable area corresponding to the embroidery frame 34 is read out from the EEPROM 64 and set. In this way, the area setting processing (FIG. 4) is simplified and a processing load is reduced.

In the above-described embodiment, an example is described in which the post-correction sewable area 202 is scaled down from the pre-correction sewable area 201 in accordance with the offset values (OX, OY). On the other hand, in accordance with a design of the embroidery pattern (a shape of an outer contour), the post-correction sewable area 202 may be scaled up from the pre-correction sewable area 201. In this case, the user may set positive values as the offset values (OX, OY). Further, in the above-described embodiment, the user sets the offset values of the sewable area for the two directions (the X direction and the Y direction), but the offset values may be set, respectively, for two or more directions. For example, the user may set the offset values for each of four directions, namely, the up, down, left and right directions.

In the above-described embodiment, a case is exemplified in which the sewable area is set for the substantially rectangular embroidery frame 34, but according to the present disclosure, the sewable area can be set for the embroidery frame having another shape. For example, even in a case such as an embroidery frame with a shape in which sections corresponding to long sides or short sides of a substantially rectangular shape are arc-shaped, or in a case in which an overall shape is substantially elliptical, it is possible to more accurately set the sewable area in a similar manner to that of the above-described embodiment.

The apparatus and methods described above with reference to the various embodiments are merely examples, It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a transport portion that moves an embroidery frame that holds a work cloth on which embroidery is sewn;

a contact detection portion that is disposed on an inner peripheral side of the embroidery frame and that detects contact with the embroidery frame that is moved by the transport portion;

a first position identification portion that causes the transport portion to move the embroidery frame in a first direction and that identifies a first position at which contact with the embroidery frame is detected by the contact detection portion;

a second position identification portion that causes the transport portion to move the embroidery frame in a second direction and that identifies a second position at which contact with the embroidery frame is detected by the contact detection portion, the second direction orthogonally intersecting the first direction;

a direction determination portion that determines a third direction that is a direction of a diagonal line of a first virtual rectangle, which is calculated from the first position identified by the first position identification portion and the second position identified by the second position identification portion;

a third position identification portion that causes the transport portion to move the embroidery frame in the third direction determined by the direction determination portion, and that identifies a third position at which contact with the embroidery frame is detected by the contact detection portion; and an area setting portion that, based on a second virtual rectangle that is calculated from the third position identified by the third position identification portion, sets a sewable area that is an area on which an embroidery pattern can be sewn within the embroidery frame.

2. The sewing machine according to claim 1, further comprising:

a correction value setting portion that sets correction values to one of scale up and scale down the sewable area;

wherein the area setting portion corrects the second virtual rectangle calculated from the third position, in accordance with the correction values set by the correction value setting portion, and sets the corrected second virtual rectangle as the sewable area.

3. The sewing machine according to claim 1, further comprising:

a sewable determination portion that determines whether the embroidery pattern that is sewn on the work cloth is contained within the sewable area set by the area setting portion; and a notification portion that notifies a result of the determination by the sewable determination portion.

4. The sewing machine according to claim 1, further comprising:

a storage control portion that stores the sewable area set by the area setting portion in a storage device;

wherein the area setting portion, instead of setting the sewable area based on the third position, reads out and set the sewable area stored in the storage device.

5. The sewing machine according to claim 1, wherein the first position identification portion identifies, as the first position, two coordinate positions at which contact with the embroidery frame is detected by the contact detection portion, the second position identification portion identifies, as the second position, two coordinate positions at which contact with the embroidery frame is detected by the contact detection portion, the direction determination portion calculates the first virtual rectangle, which is formed of two sides that extend in parallel to the first direction and respectively pass through the two coordinate positions indicated by the second position and two sides that extend in parallel to the second direction and respectively pass through the two coordinate positions indicated by the first position, and further identifies, as the third direction, four directions toward four vertices of the first virtual rectangle from the coordinate positions detected by the contact detection portion, the third position identification portion identifies, as the third position, four coordinate positions at which contact with the embroidery frame is detected by the contact detection portion, and the area setting portion sets, as the sewable area, the second virtual rectangle that has as its vertices the four coordinate positions indicated by the third position.

6. The sewing machine according to claim 5, further comprising:

a first coordinate identification portion that causes the transport portion to move the embroidery frame in the first direction and identifies the first position at which contact with the embroidery frame is detected by the contact detection portion, and that identifies a central coordinate of the first direction with respect to the embroidery frame, based on the two coordinate positions identified as the first position;

a second coordinate identification portion that causes the transport portion to move the embroidery frame in the second direction and identifies the second position at which contact with the embroidery frame is detected by the contact detection portion, and that identifies a central coordinate of the second direction with respect to the embroidery frame, based on the two coordinate positions identified as the second position; and a position matching portion that causes the transport portion to move the embroidery frame to a position at which the central coordinate of the first direction identified by the first coordinate identification portion and the central coordinate of the second direction identified by the second coordinate identification portion match position coordinates of the contact detection portion, before position identification is performed by each of the first position identification portion, the second position identification portion and the third position identification portion.

7. A computer program product stored on a non-transitory computer-readable medium, comprising instructions for causing a computer of a sewing machine which includes a transport portion that moves an embroidery frame that holds a work cloth on which embroidery is sewn, and a contact detection portion that is disposed on an inner peripheral side of the embroidery frame and that detects contact with the embroidery frame that is moved by the transport portion to execute the steps of:

causing the transport portion to move the embroidery frame in a first direction and identifying a first position at which contact with the embroidery frame is detected by the contact detection portion;

causing the transport portion to move the embroidery frame in a second direction and identifying a second position at which contact with the embroidery frame is detected by the contact detection portion, the second direction orthogonally intersecting the first direction;

determining a third direction that is a direction of a diagonal line of a first virtual rectangle, which is calculated from the identified first position and the identified second position;

causing the transport portion to move the embroidery frame in the determined third direction and identifying a third position at which contact with the embroidery frame is detected by the contact detection portion; and setting a sewable area based on a second virtual rectangle that is calculated from the identified third position, the sewable area being an area on which an embroidery pattern can be sewn within the embroidery frame.

8. The computer program product according to claim 7, wherein the sewing machine includes a correction value setting portion that sets correction values to one of scale up and scale down the sewable area, and the sewable area setting step corrects the second virtual rectangle calculated from the third position, in accordance with the correction values set by the correction value setting portion, and sets the corrected second virtual rectangle as the sewable area.

9. The computer program product according to claim 7, wherein the computer program product further includes instructions for causing the computer to execute the steps of:

determining whether the embroidery pattern that is sewn on the work cloth is contained within the set sewable area; and notifying a determination result as to whether the embroidery pattern is contained within the sewable area.

10. The computer program product according to claim 7, wherein the computer program product further includes instructions for causing the computer to execute the steps of:

storing the set sewable area in a storage device; and reading out and setting the sewable area stored in the storage device, instead of setting the sewable area based on the third position.

11. The computer program product according to claim 7, wherein the first position identification step identifies, as the first position, two coordinate positions at which contact with the embroidery frame is detected by the contact detection portion, the second position identification step identifies, as the second position, two coordinate positions at which contact with the embroidery frame is detected by the contact detection portion, the third direction determination step calculates the first virtual rectangle, which is formed of two sides that extend in parallel to the first direction and respectively pass through the two coordinate positions indicated by the second position and two sides that extend in parallel to the second direction and respectively pass through the two coordinate positions indicated by the first position, and further identifies, as the third direction, four directions toward four vertices of the first virtual rectangle from the coordinate positions detected by the contact detection portion, the third position identification step identifies, as the third position, four coordinate positions at which contact with the embroidery frame is detected by the contact detection portion, and the sewable area setting step sets, as the sewable area, the second virtual rectangle that has as its vertices the four coordinate positions indicated by the third position.

12. The computer program product according to claim 11, wherein the computer program product further includes instructions for causing the computer to execute the steps of:

causing the transport portion to move the embroidery frame in the first direction and identifying the first position at which contact with the embroidery frame is detected by the contact detection portion, and identifying a central coordinate of the first direction with respect to the embroidery frame, based on the two coordinate positions identified as the first position;

causing the transport portion to move the embroidery frame in the second direction and identifying the second position at which contact with the embroidery frame is detected by the contact detection portion, and identifying a central coordinate of the second direction with respect to the embroidery frame, based on the two coordinate positions identified as the second position; and causing the transport portion to move the embroidery frame to a position at which the central coordinate of the first direction identified by the first coordinate identification portion and the central coordinate of the second direction identified by the second coordinate identification portion match position coordinates of the contact detection portion, before position identification is performed by each of the first position identification step, the second position identification step and the third position identification step.

* * * * *